US011826763B2

(12) United States Patent
Ballhause et al.

(10) Patent No.: US 11,826,763 B2
(45) Date of Patent: Nov. 28, 2023

(54) CENTRIFUGE ROTOR, HOLDING CROWN AND HOLDING CROWN ARRANGEMENT THEREFOR, AND CENTRIFUGE

(71) Applicant: Thermo Electron LED GmbH, Langenselbold (DE)

(72) Inventors: Norman Ballhause, Osterode (DE); Romana Hinz, Osterode (DE); Jan Rother, Osterode (DE)

(73) Assignee: Thermo Electron LED GmbH, Langenselbold (DE)

( * ) Notice: Subject to any disclaimer, the term of this patent is extended or adjusted under 35 U.S.C. 154(b) by 553 days.

(21) Appl. No.: 16/929,175

(22) Filed: Jul. 15, 2020

(65) Prior Publication Data

US 2021/0016296 A1 Jan. 21, 2021

(30) Foreign Application Priority Data

Jul. 16, 2019 (DE) ..... 102019004958.6

(51) Int. Cl.
*B04B 7/08* (2006.01)
*B04B 5/04* (2006.01)

(52) U.S. Cl.
CPC ..... *B04B 7/08* (2013.01); *B04B 5/0407* (2013.01); *B04B 2005/0435* (2013.01)

(58) Field of Classification Search
CPC . B04B 7/08; B04B 5/0407; B04B 2005/0435; B04B 5/0421; B04B 5/0428; B04B 5/0414; B04B 7/00
See application file for complete search history.

(56) References Cited

U.S. PATENT DOCUMENTS

2003/0195104 A1* 10/2003 Hlavinka ..... B04B 5/0428 494/21
2004/0104182 A1* 6/2004 Holmes ..... A61M 1/3696 210/512.1

FOREIGN PATENT DOCUMENTS

DE 102014002126 A1 8/2015
DE 102014008219 A1 12/2015
DE 102018001675 A1 9/2019

* cited by examiner

*Primary Examiner* — Walter D. Griffin
*Assistant Examiner* — Shuyi S. Liu
(74) *Attorney, Agent, or Firm* — BakerHostetler

(57) ABSTRACT

The present invention relates to a centrifuge rotor with a rotor body and a receptacle arranged centrally therein for receiving a drive head of a drive shaft of a centrifuge which can be rotated about an axis of rotation (R), and sample receptacles for accommodating a plurality of sample containers. A holding crown is arranged on a top side (O) of the rotor body facing away from an insertion side (E) of the drive head, said holding crown having an annular base body, which encloses a central opening, and prongs extending upward away from the top side (O), wherein the holding crown is arranged in such a way that the axis of rotation (R) runs through the central opening. The present invention further relates to a holding crown for use with a centrifuge rotor and having an annular base body enclosing a central opening and prongs emanating from the base body and extending upward, wherein the prongs are offset at least in the region of their free ends by a spacing (A) from an inner edge of the base body. The present invention further relates to a holding crown arrangement comprising the holding crown, and a centrifuge comprising the centrifuge rotor, the holding crown or the holding crown arrangement.

8 Claims, 8 Drawing Sheets

CENTRIFUGE ROTOR, HOLDING CROWN AND HOLDING CROWN ARRANGEMENT THEREFOR, AND CENTRIFUGE

CROSS-REFERENCE TO RELATED APPLICATION

The present application claims priority under 35 U.S.C. § 119 of German Patent Application No. 102019004958.6, filed Jul. 16, 2019, the disclosure of which is hereby incorporated herein by reference in its entirety.

FIELD OF THE INVENTION

The present invention relates to a centrifuge rotor and a centrifuge comprising a rotor, in particular a laboratory centrifuge.

BACKGROUND OF THE INVENTION

Centrifuges are used in laboratories to separate mixtures of substances into their constituents using centrifugal force. In many applications, the mixtures of substances are biological or microbiological samples. One example is cell suspensions, which come from fermentation tanks, bioreactors or similar containers, for example, and which are to be divided into their constituents by centrifugation. Before centrifuging, the cell suspension must be transferred from the container into suitable sample containers in which they can be centrifuged. An example of such a sample container is a bottle usually made of plastic, which can be closed with a screw cap. Since it is generally desirable to handle the cell suspension under sterile conditions, the bottle must be sterilized before it is used again. To increase sterility, bottles are also known in which a tube is passed through an opening in the cap and can be connected to the container for transferring the cell suspension into the bottle. While the cap provided with the connecting tube can be disposed of after use, the problem of sterilizing the bottle for reuse remains.

In order to simplify the transfer and centrifuging of cell suspensions under sterile conditions, the applicant has described a bag system in German Patent Application No. 102018001675.8 and International Patent Application No. PCT/IB2019/051639. The bag system comprises a plurality of bags made of plastic film, into the interior of which at least one tube opens, via which the bag can be filled or emptied. The tubes of the bags are interconnected so that they open into a single feed tube. Seen from the supply tube, the tube connection branches until each of the bags is connected to the feed tube. After connection of the supply tube to the container, it is possible to fill all bags with the cell suspension at once. For centrifuging, the filled bags can then be closed by closure devices already provided in the branched tube assembly system and can be separated from the other bags by cutting the tube opening into the bag. Alternatively, the tube section opening into the bag can also be closed with a separate closure device, such as a tube clamp, and the tube is then severed in order to separate the individual bags from the bag system. The separated bags are then placed in the corresponding sample receptacles of a centrifuge rotor and are centrifuged in a manner known per se.

The bag system described above considerably simplifies and accelerates the transfer of cell suspensions into sample containers suitable for centrifugation under sterile conditions, since it allows several containers to be filled at the same time. In addition, after centrifugation, the separation of cells, usually in the form of a pellet, and liquid supernatant in the flexible bags is significantly easier than in centrifuge bottles. After the supernatant and/or cells have been removed, the bags can then be disposed of. However, it is often desirable to further process the cells isolated by centrifugation. Ideally, this is done while maintaining sterility. The bag system according to the invention also makes this possible. The separated bag can either be connected again to external components for further processing via the tube connection used for filling with cell suspension or, if necessary, a further tube connection. One possibility is, for example, a connection to a liquid supply, from which liquid is fed to the bag via the tube connection in order to resuspend the cells for further processing. In order to accelerate the liquid supply to the bags, a branched tube assembly system can be used for this purpose, by which liquid can be fed to several bags at the same time.

However, separating the bags from the bag system before centrifuging and, if necessary, recombining the bags into a bag system after centrifuging are costly and time-consuming. The closing of a bag tube and the subsequent severing of the tube are estimated to take at least 30 seconds per tube. The same applies to reconnecting the bags. This means that part of the time saved by filling the bags together is eaten up again. However, centrifuging the bag system without first separating the bags and disconnecting the tube system fails because the tubes are thrown around in the rotor chamber under the effect of centrifugal force. This harbors the danger that the tubes will be torn out of the bags and the samples contained in the bags will become unusable. There is also a risk of damage to the centrifuge from flying parts or contamination by escaping sample. The same also applies to other sample containers provided with at least one tube, such as bottles with a tube cap closure. For this reason, the tube cap closure is usually replaced by a screw cap without a tube connection before centrifuging. This also leads to increased expenditure of time.

An aspect of the present invention is therefore to improve the existing centrifuge systems in which sample containers are to be processed with at least one tube connection, to eliminate the disadvantages described above and, in particular, to reduce the time required for centrifuging such sample containers.

SUMMARY OF THE INVENTION

In a first aspect, the present invention therefore relates to a centrifuge rotor with a rotor body and a receptacle arranged centrally therein for receiving a drive head of a centrifuge drive shaft that is rotatable about an axis of rotation, and sample receptacles for accommodating a plurality of sample containers. The centrifuge rotor can basically be any type of centrifuge rotors known from the prior art, in particular both a swing-out rotor and also a fixed-angle rotor. The term "swing-out rotor" designates those centrifuge rotors in which the sample containers are pivotably mounted on holders on the rotor body and swing outward under the action of the centrifugal force during operation of the centrifuge. Usually, the sample containers are not mounted directly on the rotor body, but pivotably mounted centrifuge beakers are provided into which the sample containers are placed. An adapter can also be present between the centrifuge beaker and the sample container. In contrast, the term "fixed-angle rotor" denotes centrifuge rotors in which the sample containers do not pivot out during centrifugation, but are arranged at a constant angle with respect to the axis of rotation. For this purpose, the centrifuge rotor usually has correspondingly aligned recesses in the rotor body. The sample containers are either placed directly into the recesses or into adapters which are arranged in the recess.

The centrifuge rotor according to the present invention has in its rotor body a receptacle for a drive head of a centrifuge drive shaft which is rotatable about an axis of rotation. The specific design of the receptacle is again not restricted any further and can in principle correspond to all the designs known from the prior art. In one possibility, the receptacle is designed as a rotor hub which has a through opening into which the drive head is inserted. The side from which the drive head is inserted into the receptacle of the rotor body is referred to below as the insertion side of the centrifuge rotor. Parts of the drive head and/or the hub usually protrude beyond the surrounding surface of the top side of the rotor body after the centrifuge rotor has been attached. The top side is understood to mean that side of the rotor body which lies opposite the insertion side. Alternatively, the centrifuge rotor can also be attached using a clamping nut. In addition, centrifuge rotors are known, over the top side of which a handle protrudes, which serves to hold the rotor and can contain an actuating element which can release a locking mechanism by which the centrifuge rotor is automatically locked on the drive head. In principle, the drive head and centrifuge rotor can also be fastened to one another in any way known from the prior art. Movable locking wedges, as described in DE 102014008219 A1 and DE 102014002126 A1 of the applicant, are suitable, for example.

According to the present invention, a holding crown is arranged on the top side of the rotor body facing away from the insertion side of the drive head. The purpose of the holding crown is to hold the tubes emanating from the sample containers arranged in the centrifuge rotor and to prevent the tubes from being thrown around during centrifugation. The holding crown has an annular base body enclosing a central opening and prongs extending therefrom and extending upward away from the top side of the rotor body. The holding crown is arranged on the top side so that the axis of rotation runs through the central opening.

In one embodiment, the holding crown is arranged symmetrically around the axis of rotation. This avoids unbalance during centrifuging. It is therefore desirable if the center point of the central opening lies on the axis of rotation. Thus the holding crown is seated on the top side of the rotor body, wherein the central opening of the annular base body comes to lie over the receptacle of the centrifuge rotor. "Over" is not to be understood as being spatially offset upward (although this is one possible arrangement), but rather in such a way that in the case of a projection into the plane in which the base body rests on the top side of the rotor body, the central opening of the base body overlies the receptacle for the drive head.

In one variant, the holding crown is arranged on the rotor body in such a way that the inner edge of the annular base body runs on the outside of the outer circumference of a hub, a clamping screw, a handle or similar parts protruding in the center of the rotor body over the surface thereof. The present invention is further described below, using the example of a hub projecting above the surface for the sake of simplicity. However, the description applies equally to other parts protruding in the center of the centrifuge rotor over the surface of the rotor body. The spacing between the inner edge of the base body and the outer circumference of the hub is advantageously as small as possible and the inner diameter of the base body at its narrowest point is only just large enough so that it can be arranged around the hub without any problems. A small spacing usually means a few millimeters, for example a maximum of 5 mm, preferably less than 3 mm and, in particular, less than 2 mm. The small spacing between the inner edge of the base body and the outer circumference of the hub enables the base body to be oriented and centered in the center of the rotor body.

The base body of the holding crown according to the present invention is annular. In one embodiment, the base body is circular and, in particular, is self-contained. However, the present invention is not limited to this configuration. For example, other ring shapes are also conceivable, in particular polygonal shapes or corner-free, but not exactly circular configurations. In these cases, the narrowest internal diameter of the base body is expediently dimensioned such that the holding crown can be placed over the hub in such a way that the internal diameter of the base body runs on the outside adjacent to the outer circumference of the hub, as described. In addition, designs are conceivable in which the base body is not completely closed circumferentially, but rather has an opening in its circumference. However, this opening expediently has only small dimensions, for example less than 10% of the total circumference, in order not to reduce the stability of the holding crown too much. The annular surfaces of the base body preferably run flat and parallel to one another, but in principle other shapes are also conceivable.

Starting from the base body, several prongs extend upward in the direction of the top side of the rotor body. The prongs may extend from the inner edge and/or from the outer edge of the base body. In one embodiment, they extend upward from the outer edge of the base body. The shape of the prongs is not further restricted in principle. In principle, all forms are possible which are suitable for holding the tubes of the sample containers in such a way that they remain stored on the holding crown during centrifuging and are not thrown outward. Elongated shapes are preferred in one embodiment, wherein one of the narrow sides of each prong is arranged on the base body. Strip-shaped or tongue-shaped prongs are suitable, for example. The length of the prongs (the distance from the base body to the free end of the prongs) is also dimensioned in such a way that the tubes of the sample containers are securely held during centrifugation. Basically, the longer the better, while the maximum possible length is usually limited by the spacing between the base body and the inside of a lid that is placed on the centrifuge rotor during centrifugation. Suitable prong lengths are, for example, between 1 and 6 cm, preferably between 2 and 5 cm and, in particular, between 2 and 4 cm. The length is dependent in particular on the number and diameter of the tubes which are to be held by a respective prong, as well as the course of the prongs in the direction of their longitudinal extent.

In one embodiment, the prongs are flat in their longitudinal direction. They therefore run over their entire length at a uniform angle with respect to the surface of the base body. In an alternative embodiment, the angle with respect to the base body surface changes over the direction of longitudinal extent of the prong. The changes in angle can consist of curves or bends of the prongs. Prongs which are bent or angled along their longitudinal extent can expediently be designed to be somewhat longer than corresponding flat prongs so that the former protrude above the base body at a sufficient height. The course of the prongs is expediently chosen such that at least the region of the free ends of the prongs is offset outward relative to the inner edge of the base body by a certain spacing. This space created by the spacing serves to receive a tube section of at least one tube of a sample container which is to be centrifuged using the centrifuge rotor according to the present invention. The spacing is therefore expediently chosen taking account of the external diameter of the tubes to be fixed. A tube section of each tube of the sample containers arranged in the centrifuge rotor may be held with the aid of the holding crown according to the present invention, so that all tubes of the sample containers are securely fixed to the holding crown during centrifugation. In the context of this present invention, "fixing" means the detachable fastening of a tube or tube section to the holding crown in such a way that the tube or tube section does not detach from the holding crown during centrifugation.

Specifically, this may take place in such a way that a tube to be fixed on the holding crown is pulled from the sample container in the direction of the holding crown and placed around one or more prongs of the holding crown, so that a section of the tube runs in the holding crown, on the inside of the prongs. The tube section is expediently pushed downward as far as possible in the direction of the base body on the prongs and may be clamped or wedged between the prongs and the hub of the centrifuge rotor. Alternatively or additionally, the tube section can also be fixed between two adjacent prongs. In order to make this possible, the spacing between the adjacent prongs is also selected with regard to the external diameter of the tubes to be fixed, in such a way that the spacing substantially corresponds to the external diameter of the tube or tube section to be fastened and the tube section can be clamped or wedged between the pair of prongs. "Clamping" is intended to mean that the tube section is squeezed between the adjacent prongs. This presupposes that the spacing between the prongs corresponds at most to the external diameter of the tube section to be fixed. By contrast, "wedging" means that a tube section cannot detach from the holding crown due to changes in direction during laying along the prongs. It is not absolutely necessary that the spacing between the prongs should not be greater than the external diameter of the tube section to be fixed. Here too, however, the spacing between the prongs is based on the external diameter of the tube section, since spacings that are too large make secure wedging difficult. "Substantially" therefore means that the minimum spacing between the prongs is at most 20%, in particular at most 10%, greater than the external diameter of the tube to be fixed. It is basically sufficient if the spacing selected with regard to the external diameter of the tube is only available at certain points or in some regions in the direction of longitudinal extent of the adjacent prongs, while the spacing in the other regions can be greater. For example, it can be expedient to increase the spacing between the adjacent prongs toward their free ends in order to simplify the insertion of the tube section between the prongs. The clamping region with the spacing between the prongs adapted to the tube diameter is expediently located in a region closer to the base body, for example in a lower third of the prongs, in order to enable it to be clamped close to the base body. The descriptions made regarding the spacing between the adjacent prongs also apply analogously to the spacing between the prongs and the hub.

In principle, it is also possible to fix different tube sections between one and the same pair of prongs. These can be different tube sections of one single tube of a sample container, for example if this tube is very long and is to be fixed on the holding crown several times in different regions, or they can be tube sections of different sample containers. The tube sections are expediently clamped or wedged one above the other between the prongs. In this case, it is expedient to design the clamping region with the prong spacing adapted to the tube diameter either up to the height of the prongs to which the tubes are inserted, or to place the clamping spacing in a region immediately above the uppermost one of the tube sections.

The spacing of the individual prongs with respect to the inner edge of the base body is designed in an analogous procedure. As already described, in principle it is sufficient if the spacing is only present in the region of the free end of the prong. In one embodiment of the present invention, however, the prongs are flat and project vertically upward from the outer edge of the base body. Thus, each prong has a constant lateral spacing from the inner edge of the base body over its entire length. Assuming that the annular base body has a uniform ring width, which is preferred, but not absolutely necessary, the spacing of all prongs relative to the inner edge of the base body is the same. Symmetrical configurations of the holding crown according to the present invention are generally preferred due to the greater ease of manufacture and handling. If the spacing between the inner edge of the base body and the outer circumference of the hub of the rotor body for the drive head is small, the spacing between the prong and the inner edge of the base body substantially corresponds to the spacing between the prong and the hub. In order that a tube section of the sample container tube can be clamped on the hub, the spacing of that region of the prong that comes into contact with the tube section from the inner edge of the base body is designed to be somewhat smaller than the external diameter of the tube section, so that after fastening of the tube of a sample container to the holding crown the tube section guided into the holding crown is securely clamped. Tolerances are possible in the dimensioning of the holding crown, since on the one hand the prongs spring out somewhat when a tube section is inserted and, in addition, the tubes which are usually made of a flexible plastic can be pressed together. The at least partial return of the prongs and the tube to their initial position or shape increases the clamping effect and thus also contributes to secure holding of the tubes.

In a further possible embodiment of the holding crown, the prongs extend obliquely outward and upward from the base body (away from the top side of the rotor body). They may extend in the radial direction away from the center point of the annular base body. In one embodiment, the prongs are flat in the direction of their longitudinal extent. The spacing between the prong and the inner edge of the base body increases with increasing distance from the base body. The angle of the prong to the contact surface of the base body in this case preferably deviates relatively little from the vertical (90°) and is, for example, at least 70°. The smallest angle (i.e., 70° instead of 110°) with respect to the contact surface (the plane in which the base body rests on a substrate) is always given, regardless of the region of the base body from which the prongs extend upward, and thus, for example, regardless of whether the prongs start from the inner edge or from the outer edge of the base body. The inclined position of the prongs simplifies the insertion of the tubes and—provided the hub has a sufficient height—also allows the use of tubes of different thicknesses which, depending on their external diameter, can be inserted more or less far in the direction of the base body, until they are fastened sufficiently securely.

In a further embodiment, the prongs are angled several times, in particular twice, along the direction of their longitudinal extent and, as described, an angle should also be understood to mean a rounded bend. The first angle is preferably located in the region in which the prong adjoins the base body. In the region of the prong adjoining the base body, it initially runs obliquely outward and upward. This foot region of the prong can serve, in particular, to produce the desired lateral spacing between the free end of the prong and the inner edge of the base body. With the aid of this foot region, it is also possible, for example, to use a prong extending from the inner edge of the base body or to produce a sufficient lateral spacing from the inner edge of the base body if an annular base body of small width is used. In this case, the angle is rather flat and is, for example, between 5 and 45° with respect to the contact surface of the base body. The free end region of the prong adjoining the foot region then, after a further bend, may run parallel to the axis of rotation or at a slight angle of, for example, a maximum of 10° with respect to the axis of rotation (80° with respect to the contact surface of the base body), further outward and upward (away from the base body). In this case, the tube section is fixed by means of the free end section of the prong.

The design of the base body of the holding crown, as already described in principle, essentially depends on the design of the centrifuge rotor and, in particular, the hub thereof. In contrast, the number and design of the prongs are essentially determined by the type of sample container and, in particular, the tubes emanating from it. For example, the number of prongs is expediently selected on the basis of the number of tubes that are to be fixed by the holding crown. If the centrifuge rotor is, for example, one in which only two opposing sample receptacles are formed, each of which can hold a sample container, and if each of the sample containers has a tube, two prongs are sufficient in principle in order to fix these tubes. For this purpose, each of the tubes is pulled from the sample container to one of the prongs, is guided around it and clamped between the prongs and the hub of the centrifuge rotor. The prongs are expediently located on opposite sides of the base body, which is aligned on the top side of the rotor body such that the prongs come to lie adjacent to the sample receptacles for the sample containers. However, for holding a tube it is preferable to use two adjacent prongs which are spaced apart from one another such that a section of the tube can be passed between the prongs. In addition, as described, the tube section can be passed around one of the prongs and clamped between the inside of the prong and the hub. In principle, it does not matter whether the tube section is first led from the outside around one of the prongs into the inside of the holding crown and then led outward again between the adjacent prongs, or vice versa, is first led inward between the adjacent prongs and then outward again around one of the prongs. Therefore, a variant of the embodiment described above with only two sample containers thus uses two pairs of prongs and thus a total of four prongs. In this respect, a possible minimum number of prongs in the holding crown according to the present invention is four. As the number of sample containers increases, the total number of prongs preferably increases by two in each case. If a sample container has many tubes or if several sample containers are arranged together in a holder for centrifuging, which also leads to an increase in the number of tubes, several pairs of prongs in the holding crown can also be assigned to one holder. Alternatively, as already described, it is possible to fix a plurality of tubes to a pair of prongs by passing tube sections of different tubes one above the other between the prongs. A holding crown according to the present invention may have between 4 and 24, particularly between 4 and 20, in particular between 8 and 18 and very particularly between 12 and 18 prongs. These are distributed on the base body in such a way that they come as close as possible to the associated holder of the centrifuge rotor, and are, in particular, evenly distributed over the circumference of the base body, wherein the uniform distribution can relate both to the individual prongs and also to groups, in particular pairs, of prongs. In the example described above with two times two prongs, the two pairs of prongs are arranged opposite each other on the base body—and thus are uniformly distributed.

The holding crown according to the present invention can in principle be made of any material that is suitable to withstand the loads during centrifuging and when attaching and removing the tubes. In one variant of the present invention, the holding crown consists of metal such as aluminum or steel, in particular spring steel. The holding crown may be formed in one piece, that is, without individual parts being assembled to form the finished holding crown. One possible manufacturing method is 3D printing. However, if the holding crown consists of a metal, it may be produced from a metal sheet, a preform first being cut out of the metal sheet, for example by punching out or cutting out with a laser. The preform is then formed into the finished holding crown by shaping, the shaping comprising, in particular, bending of the prongs out of the plane of the preform. In the preform, the prongs can either run outward from the outer edge of the base body or, if the inner diameter of the central opening is large enough, also inward from the inner edge of the base body. In the latter case, the prongs are then bent obliquely outward in order to be able to realize the lateral spacing of at least the region of the free ends of the prongs from the inner edge. Another possibility is to separate a comb-like preform from a metal sheet and then to close it into a ring. The abutting edges can be welded together, for example. The side edges of the preform can run obliquely, so that the length of the preform increases from the region of the continuous strip corresponding to the base body to the tips of the prongs. After the ring closure, this results in a holding crown, the diameter of which is smaller in the region of the base body than in the region of the prongs. If desired, the prongs can then be additionally bent in order to give them one of the shapes described above, for example with free ends running parallel to the axis of rotation. In another variant, the side edges of the preform run perpendicular to the direction of their longitudinal extent. In this case, the prongs are then bent outward after the ring closure in order to create the desired spacing from the inner edge of the base body. Alternatively, the holding crown can also be made from a suitable plastic, for example by means of injection molding.

As a rule, the fixing of tube sections for attaching the tubes of the sample containers to the holding crown is sufficient to ensure that the tubes do not detach from the holding crown during a centrifugation process. For additional securing of the tubes to the holding crown, however, a securing ring can also be used according to the present invention. The securing ring is placed on the holding crown after the tubes have been fixed to the holding crown. The securing ring has an annular base body enclosing a central opening and prongs emanating therefrom and extending radially outward. Basically, the securing ring thus corresponds to the preform of the holding crown described above, which is produced from a metal sheet. When it is placed on the holding crown, the securing ring is rotated relative to the holding ring so that its prongs come to lie in the intermediate spaces between adjacent prongs of the holding ring. The number of prongs of the securing ring does not have to match that of the holding crown, but can also be less. The securing ring thus rests like a cover on the holding crown and the tubes fixed thereto and, by its weight, presses the tubes downward in the direction of the base body of the holding crown. Since the securing ring, like the holding crown and tubes, is mounted close to the axis of rotation and is additionally interlocked with the holding crown, there is no risk that it will be flung away during centrifugation. If desired, additional security can of course be provided. A combination of holding crown and securing ring forms a holding crown arrangement according to the present invention.

The holding crown can be fixedly or detachably connected to the centrifuge rotor. Any suitable fastening method can be used for fastening. For example, welding, soldering, gluing or the like are suitable. As examples of detachable connections, mention may be made of screw connections or fastening with other releasable fixing means, releasable snap connections or latching connections, etc. As a rule, however, it is sufficient to place the holding crown loosely on the surface of the rotor body. Alignment means, such as centering projections or the like, can be used to align the holding crown in the desired position on the rotor body, as also when using the fastening methods described. The alignment means can also contribute to preventing displacement of the holding crown during centrifugation. The fixing of the tube sections between the prongs of the holding crown and the hub of the rotor body holds not only the tubes but also the holding crown in position with respect to the rotor body, so that generally no further fastening steps are necessary. Since the holding crown is arranged in the vicinity of the axis of rotation, that is to say in a region in which the centrifugal forces are only slight, only small forces act on both the holding crown and the tubes fixed thereto. This also contributes significantly to the fact that the position of the components described does not change, or changes only very slightly, during centrifugation.

Correspondingly, the centrifuge rotor according to the present invention and the holding crown used therein enable centrifugation of sample containers with tubes protruding outward without having to take special measures such as disconnecting the tubes. Sample containers that can be centrifuged with the aid of the centrifuge rotor according to the present invention or a centrifuge rotor comprising this centrifuge rotor include, in particular, the following: a bottle which can be closed by a cap, wherein the at least one tube is guided through an opening in the cap; a film bag in which one end of the at least one tube is sealed, in particular glued or welded; an arrangement of a plurality of film bags, in each of which one end of at least one tube is sealed, in particular glued or welded, wherein the other ends of the tubes are connected to one another. In particular, those sample container systems can be centrifuged which are described in German Patent Application No. 102018001675.8 and International Patent Application No. PCT/IB2019/051639. Reference is hereby expressly made to these two patent applications and their content is hereby incorporated into this application. The bag systems described can be centrifuged together with the branched tube assembly. Under certain circumstances, only the common supply tube which is used to connect the bag system to a fermentation tank, bioreactor or the like, has to be shortened. However, it is not necessary to separate the individual bags of the bag system. As is customary for the separated bags, the individual bags are placed either individually or in groups into the sample receptacles of the centrifuge rotor according to the present invention. The tubes which protrude upward from the sample receptacles and are still connected to one another are led to the holding crown and, as already described above, are fixed there by means of the prongs of the holding crown. This preferably takes place in the region of the branching points, such as T or Y connectors, which are expediently placed between adjacent prongs in such a way that their stem lies between the prongs and the branched side parts lie on the inside of the prongs. After the centrifugation process is complete, the bag system can be removed again and sent for further processing. Unlike in the prior art, it is no longer necessary to reconnect the individual bags to form a bag system. With the aid of the present invention, it is possible to save on both the separation of the individual bags from the bag system and also the reassembly of the separated bags into a bag system. This means considerable time and cost savings.

BRIEF DESCRIPTION OF THE DRAWINGS

The present invention will be described in more detail below with reference to the accompanying drawings. The drawings are purely schematic and serve to explain preferred exemplary embodiments of the present invention, without the present invention being limited to these examples. In the drawings, identical parts are provided with the same reference symbols, although not all parts are always designated by a reference sign. In the drawings, in detail.

DETAILED DESCRIPTION OF THE INVENTION

Figure 1:
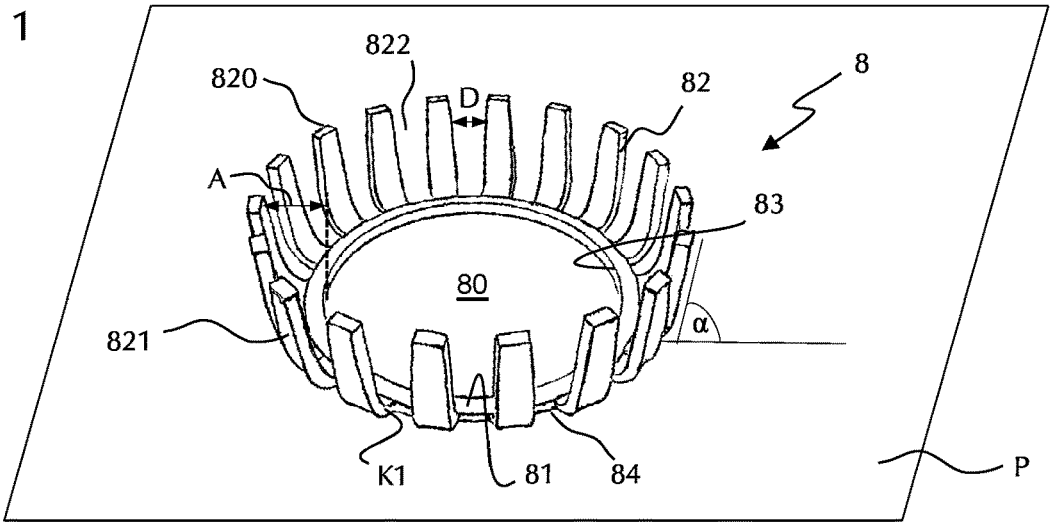
FIG. 1 shows a perspective view of a first embodiment of a holding crown according to the present invention.

FIG. 1 shows a first embodiment of a holding crown 8 according to the present invention in a perspective view. The holding crown 8 may be made of a metal, in particular aluminum or steel, in particular spring steel, or a plastic. It has an annular base body 81, which is flat and extends with its invisible underside in a plane P which forms the contact surface of the base body. The base body 81 has an inner edge 83 which surrounds a circular central opening 80. A plurality of prongs 82, in this case 18 prongs, extend in a uniform distribution around the outer circumference away from the outer edge 84. All prongs 82 are of the same design, i.e., they have the same shape and the same dimensions. In the region of their respective connection to the base body 81, the prongs 82 have a bend K1. This has the shape of a rounded bend, which is designed such that the bent regions 821 of the prongs 82 adjoining the bend K1 run outward and upward from the base body 81. The angle α by which the bent region 821 of each prong 82 extends with respect to the plane P is approximately 75° in the example shown. The course of the bent region and the angle α with respect to the contact surface P are shown, for example, in the right-hand area of FIG. 1 for one of the prongs 82 offset laterally with respect thereto. The angle α is defined as the smallest angle with respect to the plane P for all prongs 82 along the circumference of the base body 81 and corresponds in each case to approximately 75°. In the region of its free end 820, each of the prongs 82 has a spacing A from the inner edge 83 of the base body 81. Overall, the holding crown 8 can be described as crown-shaped.

Figure 2:
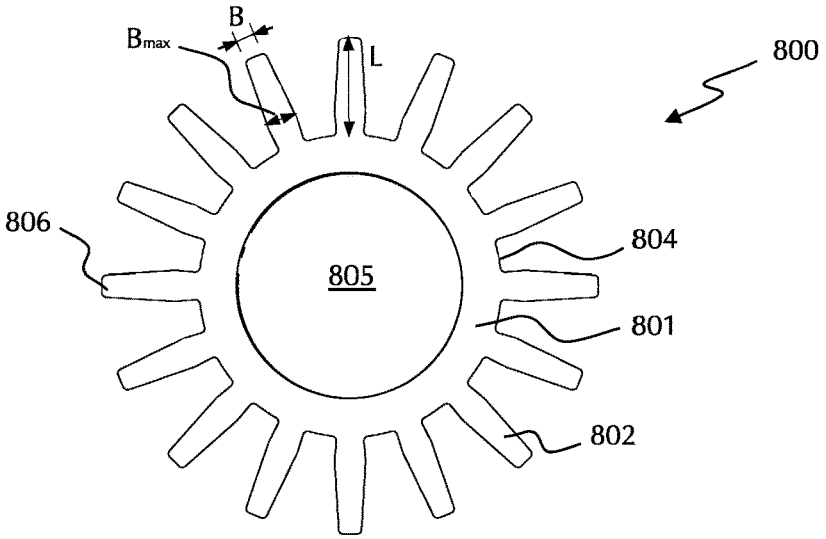
FIG. 2 shows a preliminary stage of a holding crown similar to that of FIG. 1, which can also be used as a securing ring together with a holding crown.

FIG. 2 shows the plan view of a possible preliminary stage of a holding crown 8. In contrast to the finished holding crown according to FIG. 1, the preliminary stage according to FIG. 2 has sixteen instead of eighteen prongs. Accordingly, this preliminary stage would lead to a holding crown with sixteen prongs evenly distributed around the outer circumference of the base body. Conversely, one would have to use a preliminary stage with eighteen prongs 802 arranged uniformly distributed along the outer edge 804 of the base body 801 in order to arrive at the holding crown 8 shown in FIG. 1. Apart from the different number of prongs, there are no fundamental differences between the preforms with sixteen and eighteen prongs, so that what is described below for a preform with sixteen prongs applies equally to a preform with eighteen or any other number of prongs. The preliminary stage 800, like the finished holding crown 8, has an annular, flat base body 801. Its inner edge 803 surrounds a circular central opening 805. Prongs 802 of the same design, distributed uniformly around the outer circumference, extend from the outer edge 804. They run in a radial direction outward with a length L and lie in the same plane as the base body 801. Overall, the preliminary stage 800 can therefore be described as a flat radiating ring. The width B (extension perpendicular to the length L) varies in the longitudinal direction of the prongs 802. For all prongs 802, the width initially increases slightly outward from the outer edge 804 and reaches a maximum width $B_{max}$ in the first third of the total length L. Then the width B gradually decreases continuously toward the free ends 806 of the prongs, so that the width of the free end corresponds approximately to that in the connection region of each prong 802 to the outer edge 804 of the base body 801. The spacing D between the prongs 82 varies accordingly with the spacing from the outer edge 84 of the base body 81. The preliminary stage 800 is preferably produced from a metal sheet by punching out or cutting out, for example with the aid of a laser. The finished holding crown 8 is then produced by bending the prongs out of the plane of the metal sheet.

Figure 3:
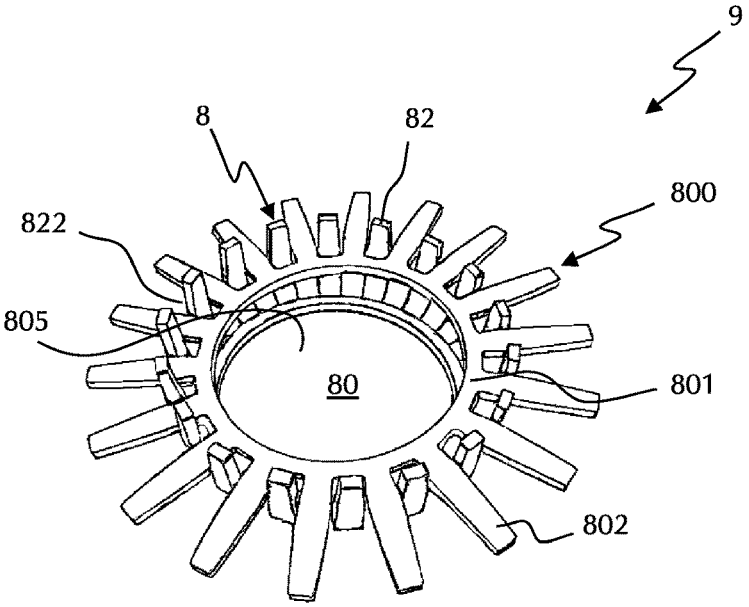
FIG. 3 shows a holding crown arrangement according to the present invention consisting of the holding crown according to FIG. 1 and a securing ring.

FIG. 3 shows a holding crown arrangement 9 according to one embodiment of the present invention in plan view. The holding crown arrangement consists of a holding crown 8 and a securing ring 800. In the example shown, the holding crown 8 corresponds to that shown in FIG. 1. The securing ring 800 is placed thereon. The latter is a preliminary stage for the holding crown 8, similar to that described in connection with FIG. 2, but now with eighteen prongs 802. A holding crown according to FIG. 1 can thus be obtained from such a securing ring by bending the prongs 802 upward. The securing ring 800 is placed in a rotated position relative to the holding crown 8 in such a way that its prongs come to lie in the spaces 822 of the holding crown 8. It serves to press down the tubes of a sample container (not shown here) fixed to the holding crown 8 and in this way even more reliably to prevent the tubes from detaching from the holding crown 8 during centrifugation.

Figure 4:
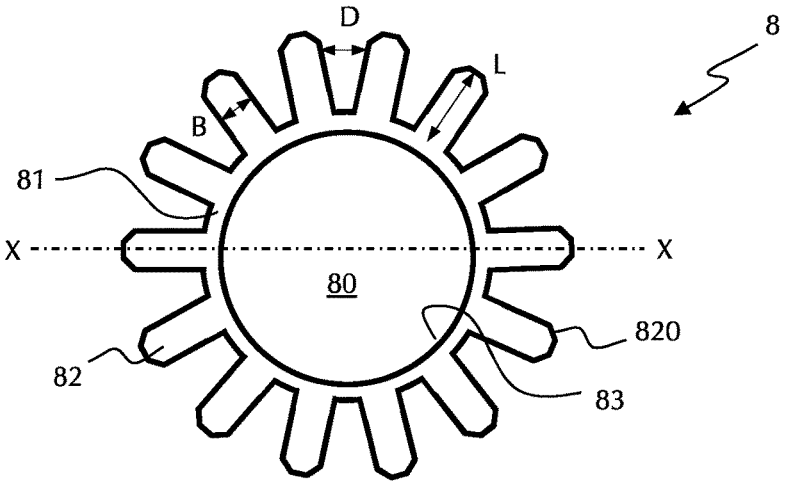
FIG. 4 shows a second embodiment of a holding crown according to the present invention.

FIG. 4 shows a further example of a holding crown 8 according to one embodiment of the present invention in a plan view. The holding crown 8 again has an annular base body 81, the inner edge 83 of which surrounds a circular central opening 80. In the example shown, fourteen prongs 82, which are distributed uniformly and have the same design, extend outward and upward from the base body 81. The prongs 82 have a width B that is substantially uniform over their entire length L. They are only beveled in the region of their free ends 820, so that the spacing D in this region also widens, which facilitates insertion of the tubes of a sample container, not shown here.

Figure 5:
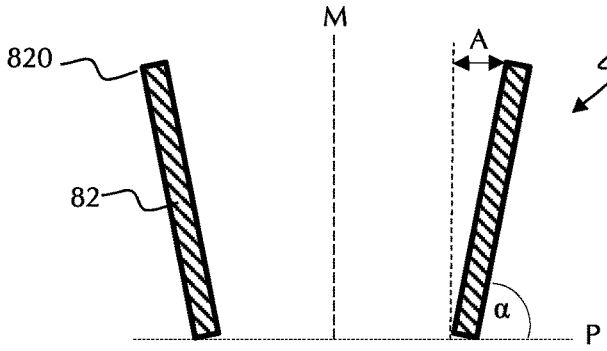
FIG. 5 shows a sectional view taken along the line X-X in FIG. 4 with a first arrangement of the prongs.
Figure 6:
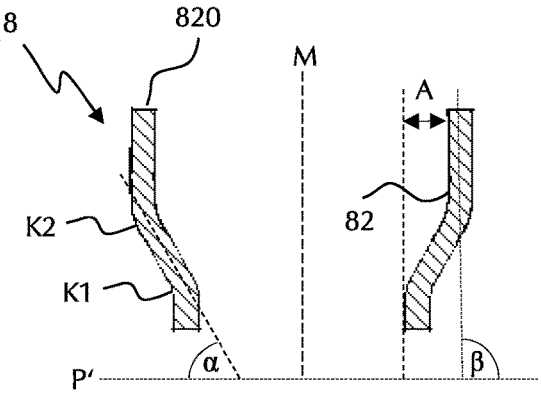
FIG. 6 shows a sectional view taken along the line X-X in FIG. 4 with a second arrangement of the prongs.

FIGS. 5 and 6 are cross sections along the line X-X in FIG. 4 and show different configurations of the holding crown 8. In the example in FIG. 5, the diameter of the holding crown 8 widens uniformly from below (the contact surface P of the base body 81) to the top (the free ends 820 of the prongs 82). The angle α between the contact surface P and the longitudinal direction of the prongs 82 is preferably again in a range between 70 and 90° and is specifically approximately 75° here. How large the angle is selected to be in the individual case also depends, in particular, on the external diameter of the tubes of the sample containers which are to be fixed on the holding crown 8. It is expediently chosen such that the spacing A of the prongs 82 substantially corresponds to the external diameter of the tubes, at least in the region of their free ends 820.

FIG. 6 shows another variant of the configuration of the prongs 82 in the holding crown of FIG. 4. Two bends K1 and K2 are each provided in the longitudinal course of the prongs. The bend K1 lying adjacent to the base body 81 is first bent outward by an angle α. The angle α is approximately 60° here. With the second bend K2, the prongs are then bent back toward the interior of the holding crown such that they run substantially parallel to the central axis M of the holding ring, which usually coincides with the axis of rotation R of the centrifuge rotor after the holding crown has been placed on the top side of a centrifuge rotor. Accordingly the angle β with respect to the contact surface P of the holding crown is 90°. For the sake of clarity, the angles are shown here in relation to a plane P' displaced in parallel. In this way also, a spacing A to receive a tube of a sample container can be produced between the free ends 820 of the prongs 82 and the inner edge 83 of the base body 81.

Figure 7:
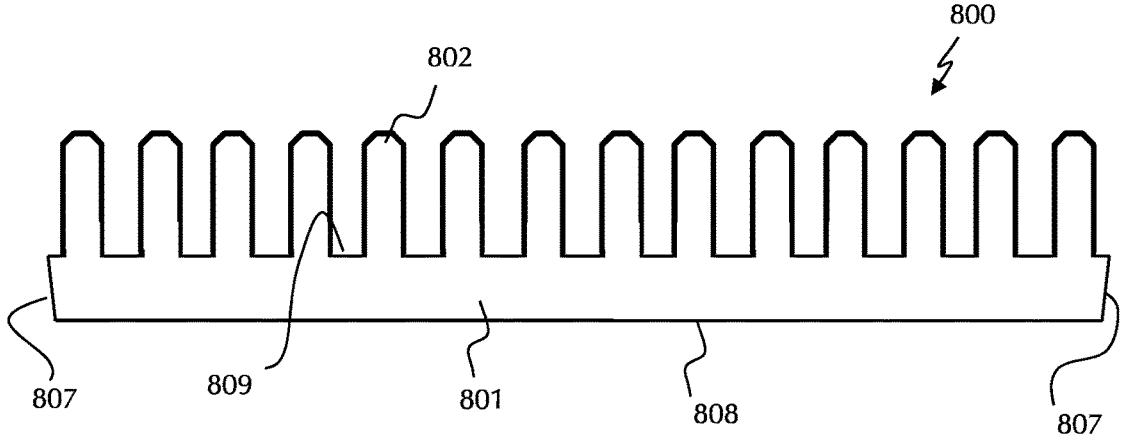
FIG. 7 shows a preliminary stage of the holding crown according to FIG. 4 in plan view.

FIG. 7 shows a preliminary stage 800, as can be used to produce a holding crown 8 according to FIG. 4. The preliminary stage 800 is again preferably produced from a metal sheet by cutting out, for example by punching or lasering. The preliminary stage 800 essentially has the shape of a comb with a strip 801, which corresponds to the later base body, and prongs 802 extending perpendicularly to it in the same plane. The front ends 807 of the strip 801 are inclined in such a way that the lower edge 808 has a somewhat shorter length than the edge 809 from which the prongs 802 originate. If the strip 801 is closed to form a ring so that the edges 807 abut one another, a holding crown results, as is shown in FIG. 5. Its diameter is smallest in the region of the lower edge 808 and increases continuously in the direction of the free ends 820 of the prongs. A holding crown according to FIG. 6 can be produced by subsequent bending of the prongs. This also takes place from a preliminary stage 800, in which the abutting edges 807 do not run obliquely, but rather perpendicular to the edges 808 and 809.

Figure 8:
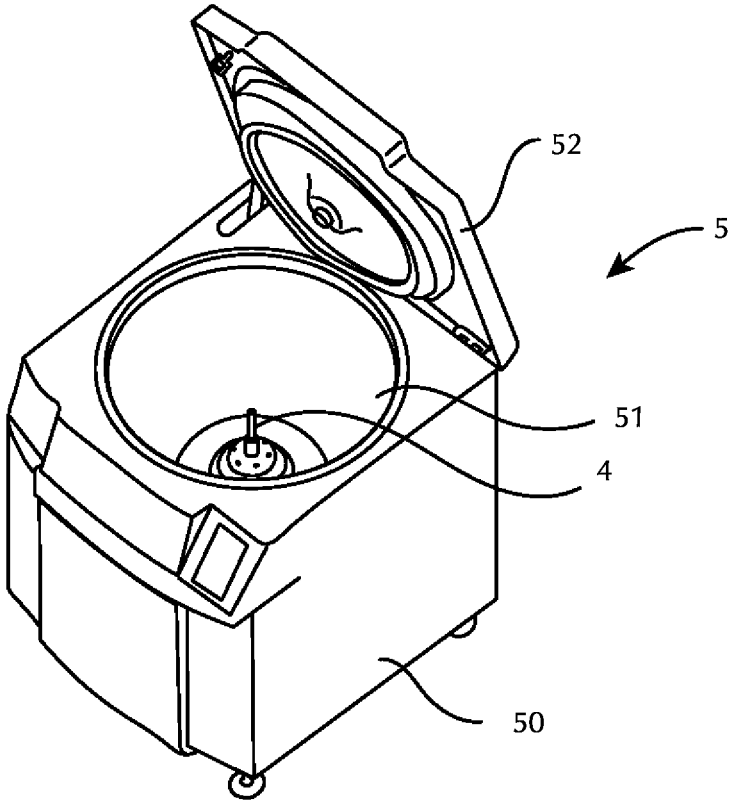
FIG. 8 shows a perspective view of a centrifuge for use in the present invention.

FIG. 8 shows the basic structure of a centrifuge according one embodiment of the present invention, which is preferably a laboratory centrifuge. In the specific example, it is a stand-alone centrifuge, which due to its size is also suitable for centrifuging large sample containers. However, the present invention also relates to other types of centrifuges such as table centrifuges. The centrifuge 5 has, inside its housing 50, a cavity 51 which is a rotor chamber for receiving a centrifuge rotor. The centrifuge rotor is placed onto a drive head 4 protruding into the rotor chamber and connected to it in a rotationally fixed manner. The drive head 4 is set in rotation via a drive shaft coupled to a motor (not shown in the illustration). As a result, the centrifuge rotor and the sample containers accommodated therein also rotate, as a result of which the samples contained in the sample containers are separated into their constituents under the action of the centrifugal force according to the density. The rotor chamber 51 can be closed with a lid 52.

Figure 9:
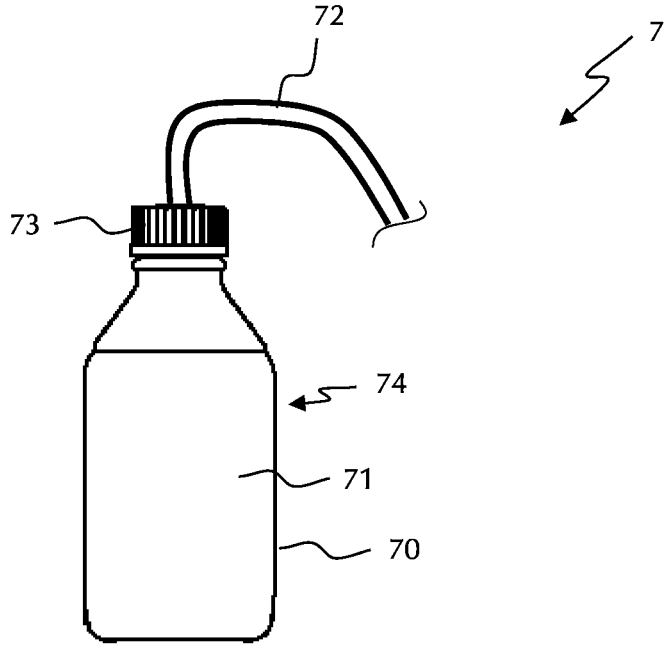
FIG. 9 shows a side view of a sample container in the form of a centrifuge bottle with a tube cap.
Figure 10:
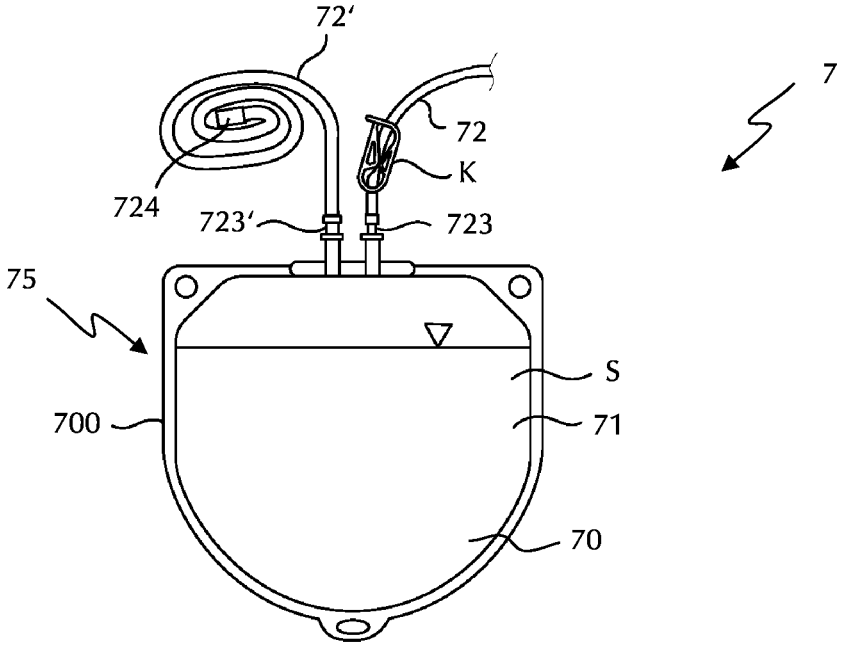
FIG. 10 shows a side view of another sample container in the form of a film bag with tube connections.
Figure 11:
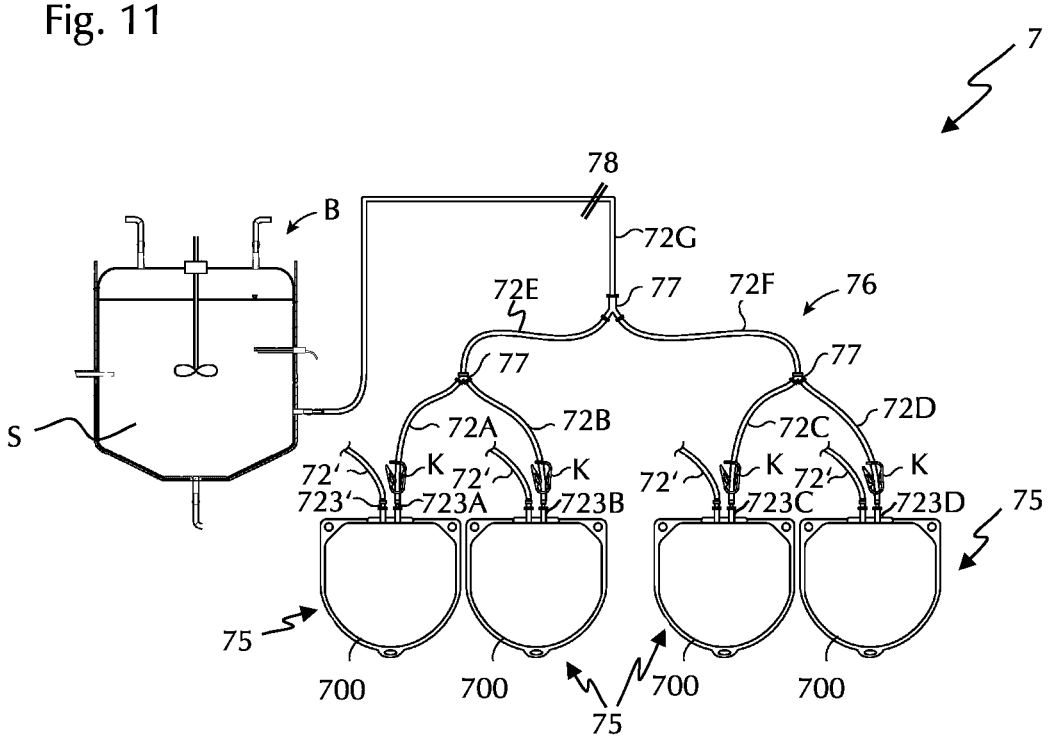
FIG. 11 shows a bioreactor with a bag system comprising a plurality of film bags which is connected to the bioreactor via a branched tube assembly.

Examples of sample containers 7 which can be processed within the scope of the present invention are shown in FIGS. 9 to 11. FIG. 9 shows a sample container 7 using the example of a centrifuge bottle. A wall 70, which is usually made of plastic, encloses a sample receptacle space 71, in which the sample to be separated can be received. The sample receptacle space 71 is accessible through an opening in the neck of the bottle. In the example shown, the opening is closed with a screw cap 73, which is screwed onto an invisible thread on the bottle neck. A tube 72 is passed through an opening in the lid 73 and opens into the sample receptacle space 71 of the bottle. Sample can be filled into the bottle 74 via the tube 72.

FIG. 10 shows a further example of a sample container 7 for use in the context of the present invention. It is a film bag 75. Its wall 70 is formed from two congruent plastic films, of which the upper region is essentially rectangular in the figure and the lower region is rounded. In the region of their outer edges, the two films are welded to one another along a circumferential seam 700 and enclose the sample receptacle space 71 between them. In the upper area of the film bag 75, a connection piece with two tube connections 723, 723' is welded in liquid-tight manner in the region of the seam 700 between the two films. Tubes 72, 72' are connected to both tube connections 723, 723'. The tube 72, which is closed here with a tube clamp K, serves to fill the film bag 75 with a sample, here in the form of a suspension S. The fill level of the sample that has not yet been processed is designated by the transverse line identified by a triangle. The second tube 72' is used for later removal of the supernatant after centrifugation and is provided with a closed connection piece 724 at its end remote from the tube connection 723'. The film bag 75 can be connected via the closed connection piece 724 to other containers for further processing, wherein the closure in the connection piece is advantageously opened by the connection. For example, the connection piece 724 has a membrane that is pierced during connection.

FIG. 11 shows a bag system which, in the example shown, has four film bags 75 which basically correspond to those in FIG. 10. They each have two tube connections, wherein a tube 72A-72D for filling the film bags is connected in each case to a first tube connection 723A-723D and a tube 72' for removal is connected in each case to a second tube connection 723'. The tubes 72A-72D are connected in pairs in several stages in such a way that they are finally brought together to form a single tube 72G via connecting tubes 72E, 72F. The tubes are advantageously brought together at the connection points with the aid of connecting pieces 77, which can be designed, for example, as T-shaped or, as shown here, Y-shaped connecting pieces. The interconnected tubes 72A to 72G are referred to below as a branched tube assembly 76. The tube 72G is connected to a conventional bioreactor B in the example shown. After the reaction, the cell suspension S located in the bioreactor should be transferred into the individual film bags 75. With the arrangement shown, this can be done quickly and easily while maintaining sterile conditions. For a more detailed description of the filling process and further details on the bag system and the individual film bags, reference is again made to German Patent Application No. 102018001675.8 and International Patent Application No. PCT/IB2019/051639. In order to separate the cells from the liquid, the film bags 75 with the sample contained therein should be centrifuged. For this purpose the bag system is first separated from the bioreactor B. This takes place after the tube clamps K have been closed, for example by cutting the tube 72G, which is to be identified by the two transverse marks 78 in the region of this tube. The new end of the tube 72G thus shortened is closed by means of a suitable tube closure, preferably a closed connection piece. The bag system, now separated from bioreactor B, is then transferred to the sample container of a centrifuge rotor for centrifugation.

Figure 12:
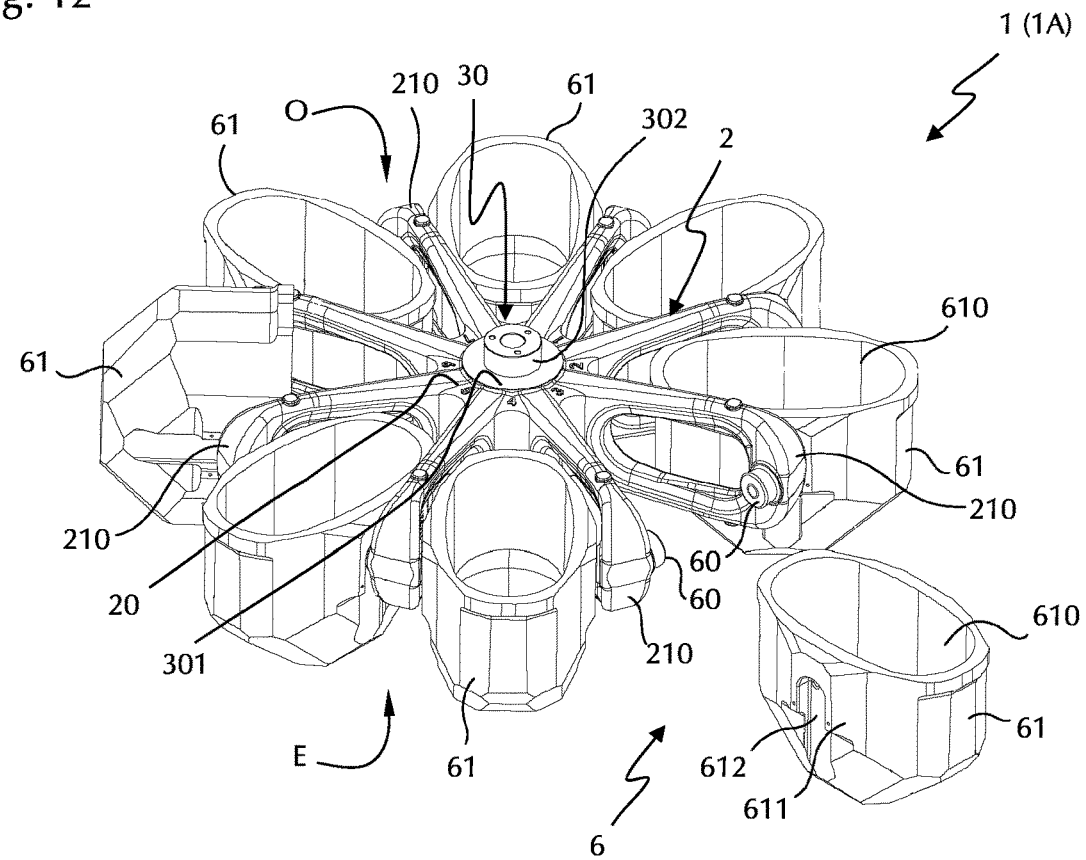
FIG. 12 shows a centrifuge rotor according to the prior art in the form of a swing-out rotor in a perspective view.
Figure 13:
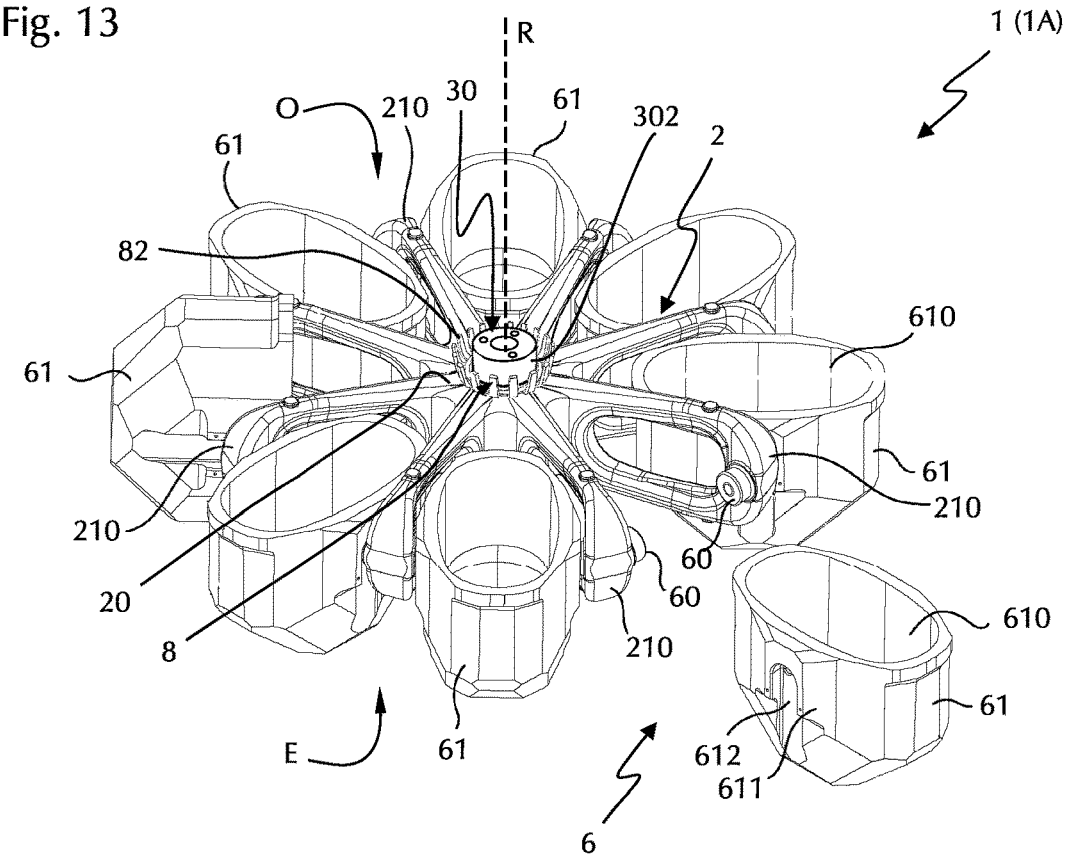
FIG. 13 shows a centrifuge rotor according to one embodiment of the present invention corresponding to the centrifuge rotor according to FIG. 12 with a holding crown arranged thereon.
Figure 14:
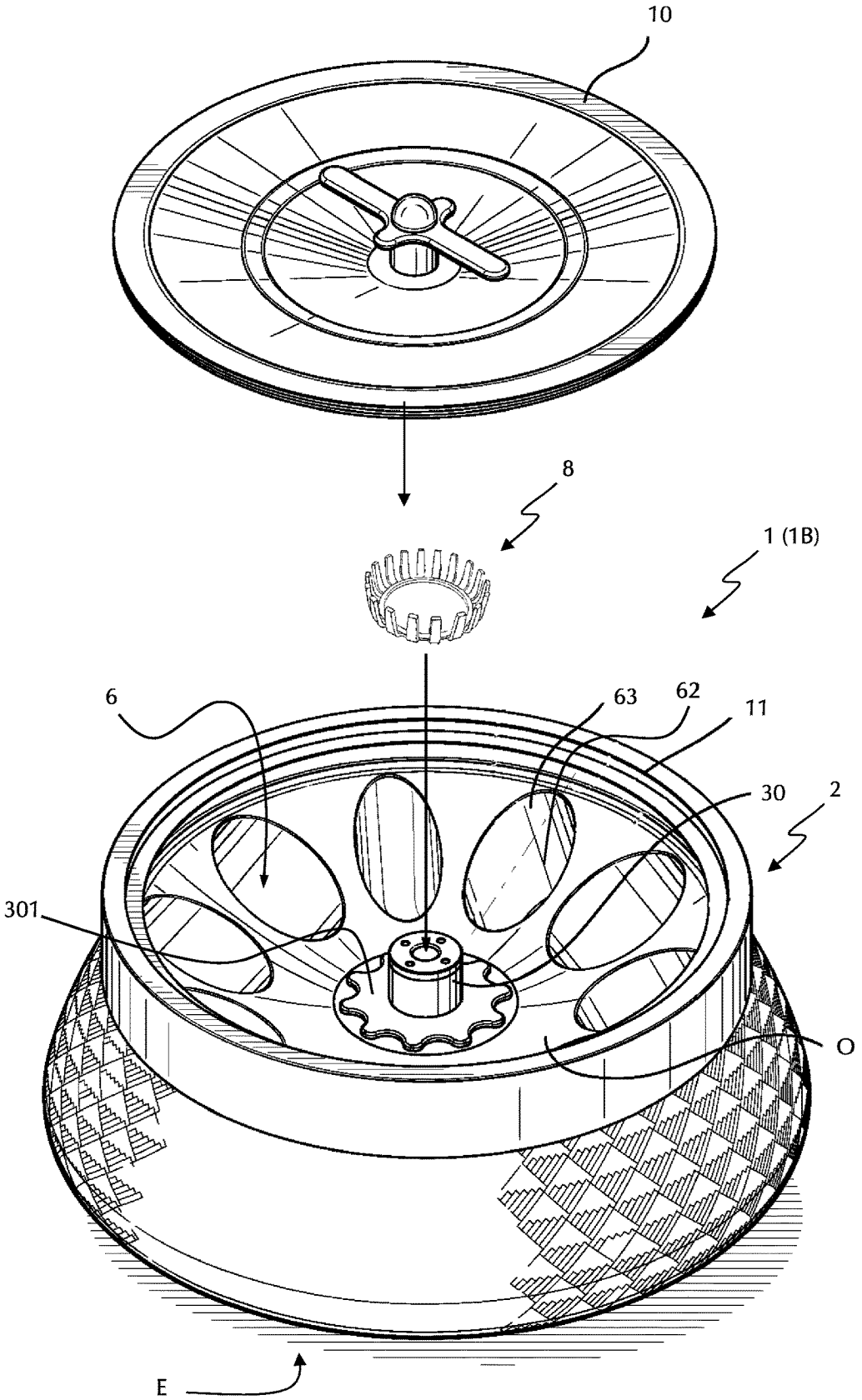
FIG. 14 shows a centrifuge rotor according to one embodiment of the present invention in the form of a fixed-angle rotor with a holding crown and rotor lid in an exploded view.
Figure 15:
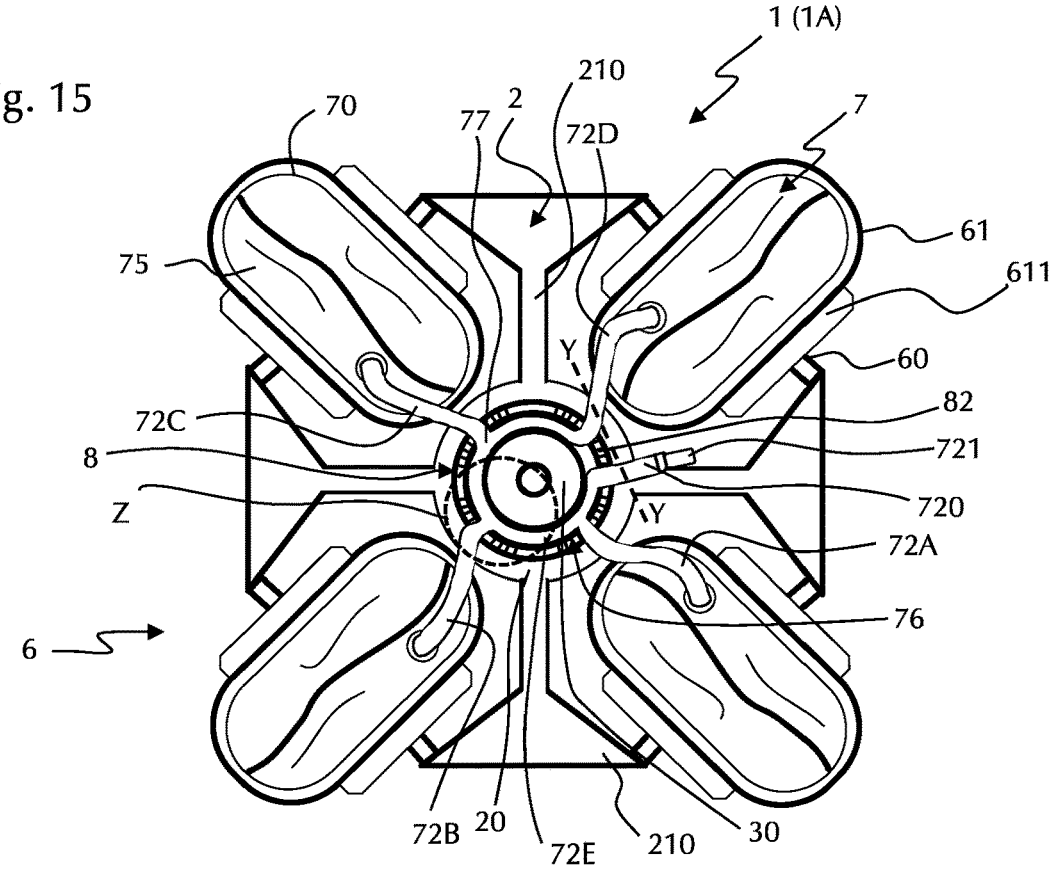
FIG. 15 shows a further example of a centrifuge rotor according to one embodiment of the present invention in the form of a swing-out rotor with a bag system arranged therein in a plan view of its top side.

FIGS. 13 to 15 show examples of centrifuge rotors 1 according to exemplary embodiments of the present invention which can be used for centrifuging the sample containers described above. Suitable centrifuge rotors basically correspond to the centrifuge rotors such as are known from the prior art. They differ from them in principle only by the use of a holding crown according to the present invention or a holding crown arrangement according to the present invention. In order to illustrate this difference, a conventional centrifuge rotor will first be described with reference to FIG. 12 using the example of a swing-out rotor 1A. The swing-out rotor 1A has a rotor body 2 with a central body 20, which essentially has the shape of a sleeve. In the example shown, eight holding arms 21 extend radially outward from the central body 20. Holders 60 in the form of holding pins extend from their outer ends 210 on both sides. Centrifuge beakers 61 can be mounted on the holding pins so as to be pivotable about a pivot axis passing through the longitudinal axis of opposing holding pins. For this purpose, the centrifuge beakers 61 have projections 611 on opposite outer sides, each of said projections defining a receiving cavity 612 for a holding pin 60. FIG. 12 shows a total of eight centrifuge beakers 61, seven of which are already attached to the holders 60. The centrifuge beaker 61, which is arranged on the far left in the picture, is shown to illustrate the pivoting process in the pivoted-out state, which is actually only taken during centrifugation. The remaining seven suspended centrifuge beakers are shown at rest, hanging downward in the direction of gravity. The eighth centrifuge beaker 61, shown at the bottom right in the picture, has not yet been attached to the centrifuge rotor 1. The holders 60 and centrifuge beaker 61 together form the sample receptacle 6 of the swing-out rotor 1A. The sample containers 7 to be centrifuged are placed in the centrifuge beakers 61 hanging on the holders 60. If necessary, an adapter (not shown here) can be arranged beforehand in the interior 610 of the respective centrifuge beaker 61. Such adapters are used in a manner known per se to stabilize and protect the sample container in the centrifuge beaker. In the example shown, the interior 610 of the centrifuge beaker 61 has an oval cross section. Correspondingly, the centrifuge beakers are suitable for holding sample containers with an oval shape, but are designed here, in particular, for holding film bags, such as are shown by way of example in FIGS. 10 and 11.

Before a centrifugation process is performed, the centrifuge rotor 1 is first placed in the rotor chamber 51 of a centrifuge, such as that shown in FIG. 8, and coupled to the drive head 4. The side of the centrifuge rotor from which the drive head 4 is inserted into the centrifuge rotor is referred to below as the insertion side E. The side of the rotor body 2 opposite the insertion side E is referred to below as the top side O. In the example shown, a hub 30, which is inserted into the opening of the central body 20 and essentially shaped as a sleeve, serves to receive the drive head 4. The hub 30 protrudes above the top side O of the rotor body 2. The centrifuge rotor 1 according to one embodiment of the present invention shown in FIG. 13 differs from that shown in FIG. 12 only in that a holding crown 8 is placed on the top side O of the rotor body 2. The holding crown 8 is pushed from above over that part of the hub 30 which protrudes over the top side O of the rotor body 2. It lies loosely on an annular disk 301 which laterally surrounds the hub 30. In one variant, the holding crown can also be non-detachably fastened to the rotor body or the hub. In the example shown, the holding crown 8 corresponds to that of FIG. 1. It is designed such that the diameter of its central opening 80 is only slightly larger than the diameter of the hub 30. The inner edge of the holding crown 8 thus runs closely adjacent to the outer circumference 302 of the hub 30. The spacing is preferably only a few millimeters. The holding crown is therefore arranged in such a way that the center point of the central opening comes to lie on the axis of rotation R or deviates only very slightly therefrom. The spacing of the prongs 82 projecting over the top side O of the rotor body 2 to the outer circumference 302 of the hub 30 is therefore essentially the same in the circumferential direction for all prongs. The space thus available between the prongs and the hub serves to receive and fix the tubes of the sample containers arranged in the centrifuge beakers 61.

FIG. 14 shows a further example of a centrifuge rotor 1 according to one embodiment of the present invention using the example of a fixed-angle rotor 1B. The fixed-angle rotor 1B is essentially pot-shaped and has an outer wall 10 with a central opening arranged on the insertion side E and not visible in the figure, into which a hub 30 is inserted in order to receive the drive head of a centrifuge drive. The hub 30 projects beyond the top side O of the fixed-angle rotor 1B opposite the insertion side E. A plurality of cavities 62, each of which has an opening 63 to the top side O, is present in the interior of the fixed-angle rotor. These cavities represent the sample receptacles 6 of the fixed-angle rotor 1B for receiving sample containers. In the example shown, the sample receptacles 6 again have an oval cross section and can thus be used for centrifuging film bags, as in the case of the swing-out rotor 1A of FIG. 13. In order to be able to fix the tubes of the film bags for centrifugation, a holding crown 8 according to one embodiment of the present invention is placed on the hub 30 analogously to that described in FIG. 13. FIG. 14 shows the components of the centrifuge rotor according to one embodiment of the present invention in an exploded view for the sake of clarity. The arrows show the direction of movement during assembly. In the assembled state, the holding crown 8 lies loosely on the toothed ring 301 arranged at the side of the hub. As already described for FIG. 13, the holding crown 8 can, however, also be undetachably fastened to the rotor surface O and/or the toothed ring. The centrifuge rotor 1 can be closed with a lid 10, which in the assembled state rests on the upper edge 11 of the rotor body 2.

FIG. 15 shows a further example of a swing-out rotor 1A according to one embodiment of the present invention in a plan view of its top side O. It is basically designed analogously to the swing-out rotor of FIG. 13, but has only four holding arms 21 starting from the central body 20. Holders 60 in the form of holding pins project laterally at the ends 210 of the holding arms which widen outward. Centrifuge beakers 61 are attached to these, analogously to what is described in FIG. 13. The film bags 75 of a bag system 7, similar to that of FIG. 11, are arranged in the centrifuge beakers 61. Each of the four film bags 75 is arranged individually in one of the four centrifuge beakers 61. A first end of a tube 72A-72D is sealed in an upper region of the wall 70 of each bag 75. The respective other end opens into a connecting tube 72E, one end 720 of which is provided with a closed closure piece 721. By connection of this closure piece 721 to the supply line to a container, all of the film bags 75 can be filled with sample from the container, or conversely, all of the film bags 75 can be emptied via the supply line 720. In contrast to the arrangement described in FIG. 11, the branched tube assembly in the example of FIG. 15 has no multiple branches, but the tubes 72A-72D open directly into the connecting tube 72E at a respective branching point 77. The tube 72D of the last of the film bags 75 (top right in the drawing) is located at the end of the connecting tube 72 remote from the end 720 or—in other words—the other end of the connecting tube 720 opens into the last of the film bags 75.

The bag system 7 can be centrifuged together with the branched tube assembly 76 without the tubes 72A-72D having to be cut for this purpose. As already described in connection with FIG. 11, only the supply line 720 is shortened and closed with the closed connection piece 721 or another suitable closure. So that the tubes of the tube assembly 76 are not thrown around during centrifugation and torn off from the film bags 75, they are fixed to the holding crown 8, which is placed over the hub 30 in the center of the rotor body 2 on the upper side thereof. This takes place basically as described above. Depending on the number of tubes to be fixed, the holding crown 8 has a total of four pairs of prongs 82. These are arranged so as to be distributed around the outer edge of the base body in such a way that they each lie opposite one of the four centrifuge beakers 61. For fixing, the tubes 72A-72D are each passed through the space between a respective pair of prongs 82 and pressed down in the direction of the base body. The connecting tube 72E, into which the tubes 72A-72D open, is laid in the space between the prongs 82 and the outer circumference of the hub 30. The supply line 720 is led to the outside through the space between two adjacent pairs of prongs. Each of the connecting pieces 77 thus lies with a part in the space between the prongs 82 and the hub 30, while another piece is led outward in the space between two adjacent prongs. All tubes are thus securely fixed to the holding crown 8, and thus in the center of the centrifuge rotor 1A. If the centrifuge rotor is set in rotation, the tubes of the tube assembly 76 on the holding crown 8 remain securely fixed in a central region, on which only a small centrifugal force acts. Therefore they cannot be thrown around in the rotor chamber during centrifugation nor torn off from the film bags 75.

Figure 16:
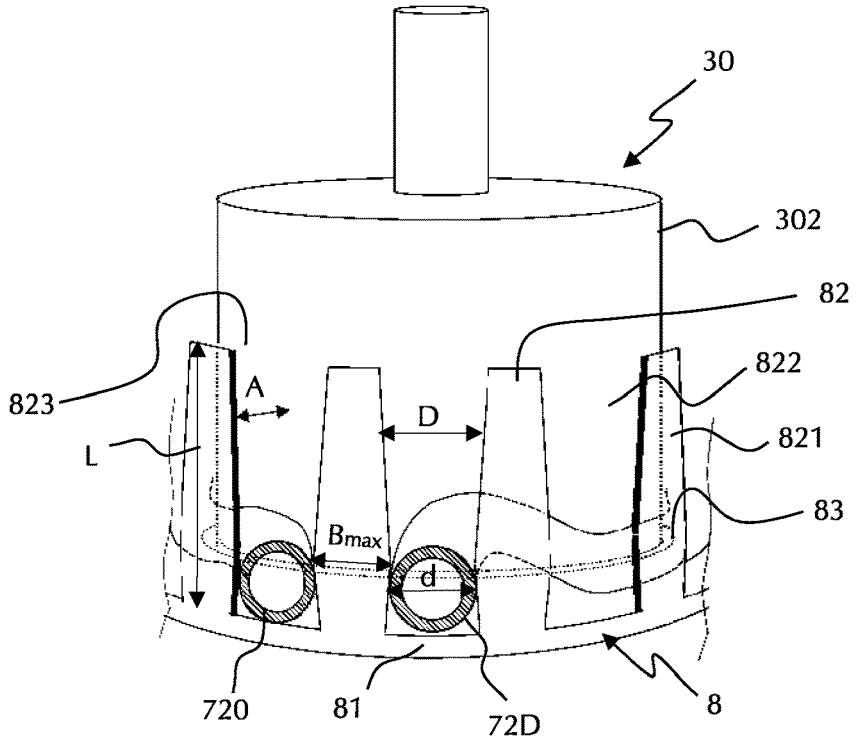
FIG. 16 shows a partial perspective sectional view taken along the line Y-Y in FIG. 15.
Figure 17:
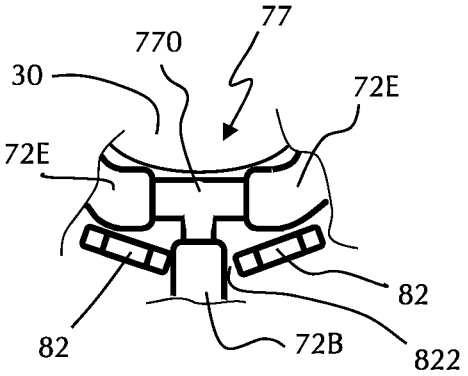
FIG. 17 shows a partial plan view of the region between the prongs and the hub of a centrifuge rotor according to one embodiment of the present invention with tubes fixed to the holding crown.
Figure 18:
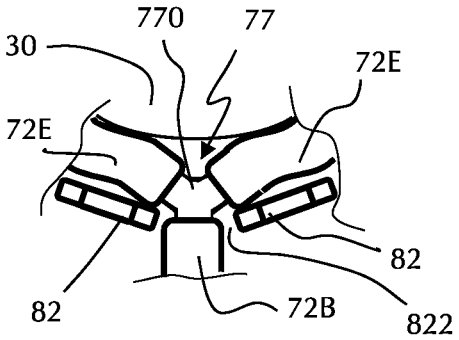
FIG. 18 shows another partial plan view of a detail corresponding to FIG. 18.

FIGS. 16 to 18 are intended to describe, in a highly simplified manner, details of the fastening of the tubes of the tube assembly 76. FIG. 16 shows a perspective sectional view in the region of the line Y-Y in FIG. 15. In section, the cross sections of the tube 72D and the supply line 720 can be seen just outside the holding crown 8. In addition, the tube sections of these tubes are then each guided between adjacent prongs 82 into the region between the inside of the prongs 82 and the outer circumference 302 of the hub 30 and then continue relocated on different sides in this intermediate space 823 along the outer circumference 302 of the hub 30. The spacing A between the inside of the prongs 82 essentially corresponds, at least in the region of the free ends 820, to the external diameter d of the tubes which are to be fixed on the holding crown 8. In the example shown, the bent regions 821 of the prongs 82 project vertically upward above the base area 81. In this case, the spacing A is the same over the entire length L of the prongs. However, as described in the previous examples, it is also possible for the spacing A to increase toward the free ends 820 of the prongs 82. By pushing down the tube sections to be fixed in the direction of the base body 81, the tube sections are thus increasingly clamped or wedged between the hub and the prongs and thus securely fixed to the holding crown. A similar procedure can also be used to fix the tube sections between adjacent prongs 82. The spacing D changes over the longitudinal direction of the prongs and has its smallest size in the region of the lower third, which is adjacent to the base body 81. Accordingly, the prongs 82 have their greatest width in this region with the width $B_{max}$. From this maximum width, the width of the prongs 82 decreases continuously upward and downward. The spacing D also essentially corresponds to the outer diameter d of the tube sections to be fixed. The position of the maximum width also suitably depends on the outer diameter d of the tube sections to be fixed and is selected such that the tube sections come to lie with at least half their cross-section below the maximum width of the prongs 82. In this way, the tube sections are securely clamped or wedged between adjacent prongs. Overall, it is not absolutely necessary that the spacings A and D each correspond exactly to the outer diameter d of the tube sections to be fixed. On the one hand, they can be somewhat smaller, since the tubes to be fixed will generally be deformable plastic tubes that can be compressed when inserted. They can therefore also be clamped in spaces in which the dimensions A and D are less than d by changing their shape. On the other hand, A and D can also be somewhat larger than d, since the tube sections to be fixed are wedged due to their bending and repeated changes in direction during their attachment to the holding crown 8 and are therefore also securely fixed.

Fixing the tubes in the region of their connection points 77 also counteracts their slipping off from the holding crown 8. Two examples of this are shown in FIGS. 17 and 18. Only a partial view of a tube assembly 76 is shown in the region of a connection point 77, which is arranged between a hub 30 and a pair of prongs 82. The view basically corresponds to an enlarged section in the region Z of FIG. 15. The opening of the tube 72B, whose other end (not visible here) opens into a film bag 75, into the connecting tube 72E is realized in the arrangement according to FIG. 17 with the aid of a conventional T-piece 770 made of plastic. Cable ties or tube clamps can be used to secure the tube ends to the T-piece, but are not shown here for the sake of clarity. The trunk of the T-piece 770 with the tube end of the tube 72B is led out through the space 822 between two adjacent prongs 82. The crossbar of the T-piece 770 with the tube 72E is located on the inside of the prongs 82 adjacent to the outer circumference of the hub 30. The T-piece 770 and the tube sections 72B and 72E adjoining it thus lie almost immovably between the prongs 82 and the hub 30 and can only be removed from there by pulling them upward. However, they remain in the position shown during centrifugation. The arrangement shown in FIG. 18 differs from that of FIG. 17 only in that a Y-piece is used instead of the T-piece.

Figure 19:
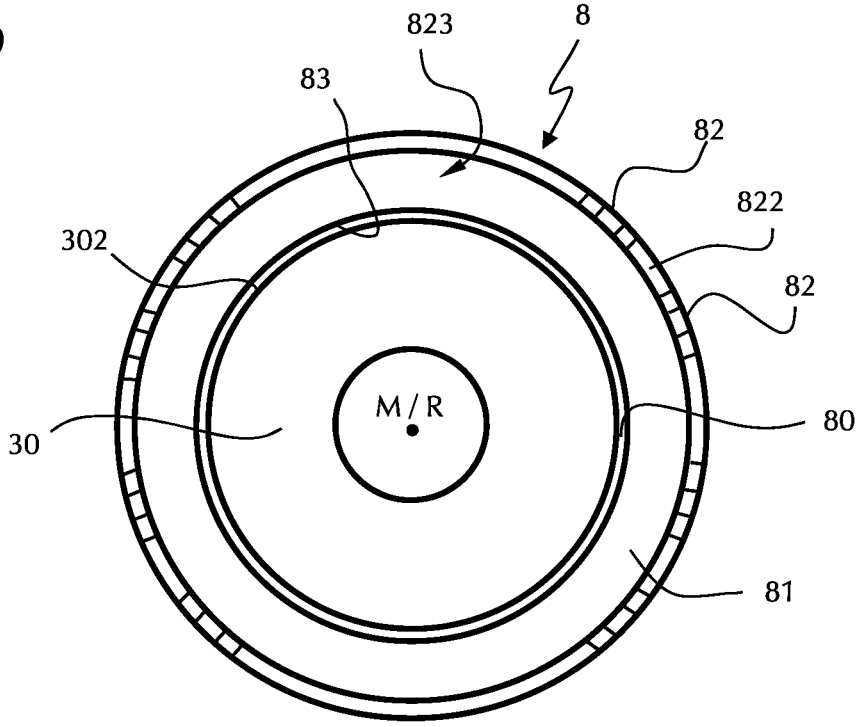
FIG. 19 shows a plan view of the arrangement according to FIG. 16, with the tubes omitted.

FIG. 19 shows a plan view of the top side of the view shown in FIG. 16. As can be seen, the diameter of the central opening 80 in the base body 81 of the holding crown 8 essentially corresponds to the outer diameter of the hub 30, above which the holding crown 8 is arranged. The inner edge 83 of the base body 81 therefore runs at a very small spacing of, for example, a few millimeters adjacent to the outer circumference 302 of the hub 30. In this way, the holding crown 8 is centered over the center of the centrifuge rotor, and the center point M of the central opening 80 coincides with the axis of rotation R of the centrifuge rotor or deviates only slightly therefrom by a few millimeters. Tubes arranged in the spaces 822 between adjacent prongs 82 and 823 between the prongs 82 and the hub 30 are thus fixed close to the axis of rotation R, so that only a small centrifugal force acts on them during a centrifugation process. The tube sections fixed between the hub 30 and the holding crown 8 also contribute to fixing of the holding crown 8 to the hub 30, so that the holding crown does not shift relative to the hub during centrifuging even if the spacing between the inner edge 83 and the outer circumference 302 of the hub is relatively great.

While the present invention present has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A centrifuge rotor, comprising:

a rotor body including a receptacle arranged centrally therein for receiving a drive head of a drive shaft of a centrifuge that is rotatable about an axis of rotation (R) and sample receptacles for accommodating a plurality of sample containers, wherein a holding crown is arranged on a top side (O) of the rotor body facing away from an insertion side (E) of the drive head, said holding crown having an annular base body which encloses a central opening and prongs extending upward away from the top side (O), and wherein the holding crown is arranged in such a way that the axis of rotation (R) runs through the central opening, wherein the sample containers have at least one tube which projects outward and opens into a sample receptacle space delimited by a container wall, wherein the sample container is selected from:

a bottle which can be closed with a cap, wherein the at least one tube is guided through an opening in the cap, a film bag in which one end of the at least one tube is sealed, and an arrangement of several film bags, in each of which one end of at least one tube is sealed, wherein the other ends of the tubes are connected to one another to form a branched tube assembly, and wherein the tubes of all of the sample containers are interconnected and wherein sections of the interconnected tubes of all the sample containers are guided between two adjacent prongs of the holding crown, wherein a respective tube section is passed between different adjacent prongs.

2. A centrifuge, comprising:

a centrifuge rotor according to claim 1.

3. A centrifuge rotor, comprising:

a rotor body including a receptacle arranged centrally therein for receiving a drive head of a drive shaft of a centrifuge that is rotatable about an axis of rotation (R) and sample receptacles for accommodating a plurality of sample containers, wherein a holding crown is arranged on a top side (O) of the rotor body facing away from an insertion side (E) of the drive head, said holding crown having an annular base body which encloses a central opening and prongs extending upward away from the top side (O), and wherein the holding crown is arranged in such a way that the axis of rotation (R) runs through the central opening, wherein the sample containers have at least one tube which projects outward and opens into a sample receptacle space delimited by a container wall and the tubes of the sample containers define a tube assembly having branching points, wherein at least one tube of at least one sample container is passed between two adjacent prongs of the holding crown, and wherein tube sections of the tube assembly are fixed to the holding crown in a region of the branching points of the tube assembly.

4. A centrifuge, comprising:

a centrifuge rotor according to claim 3.

5. A centrifuge rotor, comprising:

a rotor body including a receptacle arranged centrally therein for receiving a drive head of a drive shaft of a centrifuge that is rotatable about an axis of rotation (R) and sample receptacles for accommodating a plurality of sample containers, wherein a holding crown is arranged on a top side (O) of the rotor body facing away from an insertion side (E) of the drive head, said holding crown having an annular base body which encloses a central opening and prongs extending upward away from the top side (O), and wherein the holding crown is arranged in such a way that the axis of rotation (R) runs through the central opening, and wherein a securing ring is arranged on the holding crown and has an annular base body enclosing a central opening and radially outwardly extending prong, wherein the prongs are arranged so that they lie in spaces between adjacent prongs of the holding crown.

6. A centrifuge, comprising:

a centrifuge rotor according to claim 5.

7. A holding crown arrangement, comprising:

a holding crown for use with a centrifuge rotor, comprising:

an annular base body enclosing a central opening; and prongs emanating from the base body and extending upward, wherein the prongs are offset at least in a region of free ends of the prongs by a spacing (A) from an inner edge of the base body; and securing ring which is configured to be placed on the holding crown and which has an annular base body enclosing a central opening and prongs extending radially outwardly therefrom, wherein the prongs are arranged such that the prongs of the securing ring can come to rest in spaces between adjacent prongs of the holding crown.

8. A centrifuge, comprising:

a holding crown arrangement according to claim 7.

* * * * *